US006407490B1

(12) United States Patent
Shin et al.

(10) Patent No.: US 6,407,490 B1
(45) Date of Patent: Jun. 18, 2002

(54) TENSION MASK AND TENSION MASK AND FRAME ASSEMBLY FOR COLOR CATHODE RAY TUBE

(75) Inventors: Soon-cheol Shin, Suwon; Do-hun Pyun, Yongin; Chan-yong Kim, Incheon, all of (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 0 days.

(21) Appl. No.: 09/518,079

(22) Filed: Mar. 3, 2000

(30) Foreign Application Priority Data

Mar. 5, 1999 (KR) ..... 99-7253

(51) Int. Cl.[7] ..... H01J 29/07
(52) U.S. Cl. ..... 313/403; 313/402
(58) Field of Search ..... 313/402, 403, 313/404, 407, 269

(56) References Cited

U.S. PATENT DOCUMENTS 3,638,063 A 1/1972 Tachikawa et al. ..... 313/348
4,665,339 A * 5/1987 Masterson et al. ..... 313/403
4,942,332 A 7/1990 Adler et al. ..... 313/402
6,054,803 A * 4/2000 Saita ..... 313/402

* cited by examiner

*Primary Examiner*—Nimeshkumar D. Patel
*Assistant Examiner*—Thelma Sheree Clove
(74) *Attorney, Agent, or Firm*—Lowe Hauptman Gilman & Berner, LLP

(57) ABSTRACT

A tension mask and a tension mask and frame assembly for a color cathode ray tube (CRT). The tension mask and frame assembly includes: a tension mask including an aperture portion having a series of strips disposed at predetermined intervals to define slits, and tie bars interconnecting adjacent strips, and a non-aperture portion having side members disposed parallel to the strips on both sides of the aperture portion, wherein strips near the side of the aperture portions and the side members have a predetermined partial pin cushion curvature, and a frame including a pair of support members disposed parallel to each other, for supporting the tension mask under tension acting in the vertical direction of the strips, such that a tension acts on the horizontal direction of the tension mask through the tie bars, due to the curvature of the tension mask, and a pair of elastic members fixed to both ends of the support members for supporting the support members.

21 Claims, 6 Drawing Sheets

TENSION MASK AND TENSION MASK AND FRAME ASSEMBLY FOR COLOR CATHODE RAY TUBE

BACKGROUND OF THE INVENTION

1. Field of the Invention

The present invention relates to color cathode ray tubes (CRTs), and more particularly, to a tension mask with a color selection function and a tension mask and frame assembly for a color CRT.

2. Description of the Related Art

In color CRTs, three electron beams emitted from an electron gun land on a phosphor screen through apertures in a shadow mask with a color selection function to excite red, green and blue phosphor lines in the phosphor screen formed on the inner surface of a panel. The panel of a conventional color CRT, which forms an image as mentioned above, is designed with a predetermined inner curvature taking into account a deflection trajectory of electron beams, which have been deflected by a deflection yoke after being emitted from the electron gun. The shadow mask thereof is also designed with a curvature corresponding to that of the panel.

In the operation of a CRT, the mask manufactured to have a curvature in the same order as that of the inner surface of the faceplate is heated as kinetic energy of electron beams emitted from the electron gun is converted to thermal energy, to thereby distort the mask into the shape of a dome resulting from thermal expansion. which is referred to as a "doming phenomenon". The doming phenomenon displaces positions of the apertures formed on the mask, so that the landing positions of the electron beams are shifted. As a result, undesired phosphor lines are excited, so that the color purity of a display image is deteriorated.

The mask described above is made of steel foil having a thickness of 0.1–0.25 mm. A plurality of apertures are formed in the steel foil via etching, and then the steel foil is molded to have a predetermined curvature. If the curvature of the mask is less than a predetermined level, the mask is readily subjected to a permanent thermal distortion during manufacture of CRT. Accordingly, the mask cannot perform a normal color selection function due to its structural weakness.

Also, the mask having the above-mentioned configuration has limitations in the manufacture of flat CRTs, while the need for flat CRTs is increasing.

In order to meet the need for the flat CRTs as well as to prevent the doming of the mask, U.S. Pat. No. 3,638,063 has suggested an aperture grill type mask. As shown in FIG. 1, a mask 10 including a plurality of strips 12, grid elements, which are disposed at predetermined intervals, is supported by a frame 11 under one directional tension. The mask 10 having the grid structure is designed such that thermal strain which occurs during operation of a CRT, can be opposed by the tension applied by the mask-and-frame assembly, thereby preventing doming of the mask. However, the mask 10 with the strips 12 is made of steel foil that is 0.1 mm thick and is only supported by the frame 11 at two edges thereof, without any interconnection between adjacent strips, and thus the individual strips 12 easily vibrate when subjected to a small impact, thereby causing a howling phenomenon to arise in a display image. The tension applied to the strips 12 is proportional to the thickness of a single strip. Thus, in order to make the structural intensity withstand the thermal expansion during CRT operation, the weight of the frame 11 is inevitably increased.

To account for this problem, U.S. Pat. No. 4,942,332 discloses a mask illustrated in FIGS. 2 and 3. As shown in FIGS. 2 and 3, a mask 20 includes a series of parallel strips 22 disposed at predetermined intervals to define slits 21, and a plurality of tie bars interconnecting adjacent strips 22. Also, the longer sides of the mask are fixed to a support member (not shown).

In the mask 20, the tie bars 23 interconnecting the adjacent strips 22 can reduce howling of a display image, resulting from vibrations of the mask by an external impact, but not contributing to a reduction in the Poisson contraction. In particular, when a tension is applied in the vertical direction of the mask within the elastic limit of the material of the mask, the mask 20 is stretched in the longitudinal direction, but contracted in the transverse direction. Due to the transverse contraction, the outermost slits of the mask 20 are displaced. Furthermore, as thermal expansion raises the mask 20 during operation of a CRT, the shorter sides of the mask 20 expand outward.

The disclosure also defines a vertical-to-horizontal pitch ratio of the slits (PV/PH) to be greater than 16 such that the transverse displacement of the slits at the side of the usable picture region of the mask.

The instant inventors has carried out the following numerical analysis during research into the amount of displacement of slits at the edge of a mask with respect to vertical-to-horizontal pitch ratio (PV/PH) of slits. In particular, the specification of the mask and experimental conditions therefor were: the width of the mask (W) was 298.4 mm; the height of the mask (H) was 312 mm; the horizontal pitch (PH) of slits was 0.8 mm; the width of a single strip (W1) was 0.6 mm; the thickness of the mask (t) was 0.1 mm; Young's Modulus (E) was $2.1\times10^{-6}$ kgf/mm$^2$; the thermal expansion coefficient ($\alpha$) was $13\times10^{6}$/° C.; Poisson's ratio was 0.27; and the material used was aluminum killed (AK) steel.

In the mask having the above specifications. it was assumed that the area of the usable picture region was 387.4×288 mm, and that the total number of strips was 484. To keep the tension constant when the temperature is raised to 100° C., the amount of initial tension applied to the strips of the mask, expressed by $\epsilon=\alpha\Delta T$ should be equal to 0.0013 ($=13\times10^{-6}/100$), wherein the tension applied to a single strip, expressed by $f_{strip}=E\cdot\epsilon\cdot$ (area of a single strip), is equal to 1.638 kgf. Also, the amount of transverse contraction of a single strip, expressed by $\Delta W1=\nu\cdot\epsilon\cdot W1$, is equal to 0.211 $\mu$m. Here, since the total number of strips is 484, after application of the tension, a maximum transverse contraction of the useful picture region ($\Delta W$) becomes 102 $\mu$m. As a result the edge of the useful picture region is shifted outward by 52 $\mu$m.

FIG. 4 comparatively illustrates the amount of transverse displacement of slits in the disclosure of U.S. Pat. No. 4,942,332 and the numerical analysis by the instant inventors, with respect to the vertical-to-horizontal pitch ratio (PV/PH) of the slits. As shown in FIG. 4, according to the disclosure, the transverse displacement of the slits was 64 $\mu$m for a PV/PH of 5; 8 $\mu$m for a PV/PH of 15; and 15 $\mu$m for a PV/PH of 30. Meanwhile, the numerical analysis performed under the same conditions as those of the disclosure showed a transverse displacement of 50 $\mu$m for a PV/PH of 5 and 32.2 $\mu$m for a PV/PH of 30.

As can be noted from the above result, a decreasing tendency of the displacement with a PV/PH increase appears both in the disclosure and the numerical analysis result. However, a decrease in the Poisson contraction at the edge of the useful picture region of the mask appears to be exaggerated in the disclosure, in contrast to the numerical analysis.

In detail, according to the numerical analysis by the instant inventors, at a PV/PH of 30, the outermost slits of the mask contract by 33.7 $\mu$m from the initial positions upon the application of tension, while the outermost slits expand by 28.1 $\mu$m from the initial positions when the temperature of the mask increases to 80° C. during operation of a CRT. Accordingly, the total amount of the transverse displacement of the outmost slits, arising from the Poisson contraction and the thermal expansion, becomes 61.8 $\mu$m.

As described above, the amount of Poisson Contraction can be somewhat reduced by increasing the PV/PH ratio of slits as indicated in the disclosure. However, unlike the prediction in the prior art, it is likely that increasing the PV/PH ratio is insufficient for reducing the absolute transverse contraction of the mask. Furthermore. if the PV/PH ratio is too high, due to the strips being loosely coupled by widely spaced tie bars, strips are easily subjected to vibration, resulting in an increasing concern about image quality deterioration.

SUMMARY OF THE INVENTION

An object of the present invention is to provide a tension mask and a tension mask and frame assembly for color cathode ray tubes (CRTs), which render a biaxial tension to a mask, one in the longitudinal direction (Y-axis direction) of strips and the other in the direction (X-axis direction) of tie bars interconnecting adjacent strips, so that the amount of displacement of slits at the edges of the mask can be reduced.

Another object of the present invention is to provide a tension mask and a tension mask and frame assembly for color CRTs, capable of reducing the amount of Poisson contraction in the longitudinal direction of the mask to a minimum level.

To achieve the first object of the present invention, there is provided a tension mask for a color cathode ray tube (CRT), having a partial pin cushion shape, comprising an aperture portion including a series of strips disposed at predetermined intervals to define slits, and tie bars interconnecting adjacent strips, wherein strips near the side of the aperture portion have a predetermined partial pin cushion curvature; and a non-aperture portion having side members disposed parallel to the strips on both sides of the aperture portion, the side members also having a predetermined partial pin cushion curvature, wherein upon a tension is applied to the tension mask in the vertical direction of the strips and the side members, a tension in the horizontal direction of the strips is also applied to the tension mask.

Preferably, assuming that the maximum curvature of the tension mask is $\delta$, and the height of the tension mask is H and the width of the tension mask W. the relationship $0.00027W/2<\delta<0.01$ H is satisfied. Also, assuming that the vertical pitch of the slits is PV and the horizontal pitch of the slits is PH, a vertical-to-horizontal pitch ratio PV/PH is greater than or equal to 2.

To achieve the second object of the present invention, there is provided a tension mask and frame assembly for a color cathode ray tube (CRT), comprising: a tension mask including an aperture portion having a series of strips disposed at predetermined intervals to define slits, and tie bars interconnecting adjacent strips, and a non-aperture portion having side members disposed parallel to the strips on both sides of the aperture portion, wherein strips near the side of the aperture portions and the side members have a predetermined partial pin cushion curvature, and a frame including a pair of support members disposed parallel to each other, for supporting the tension mask under tension acting in the vertical direction of the strips, such that a tension acts on the horizontal direction of the tension mask through the tie bars, due to the curvature of the tension mask, and a pair of elastic members fixed to both ends of the support members for supporting the support members.

BRIEF DESCRIPTION OF THE DRAWING

The above objects and advantages of the present invention will become more apparent by describing in detail preferred embodiments thereof with reference to the attached drawings in which.

DESCRIPTION OF THE PREFERRED EMBODIMENTS

Figure 1:
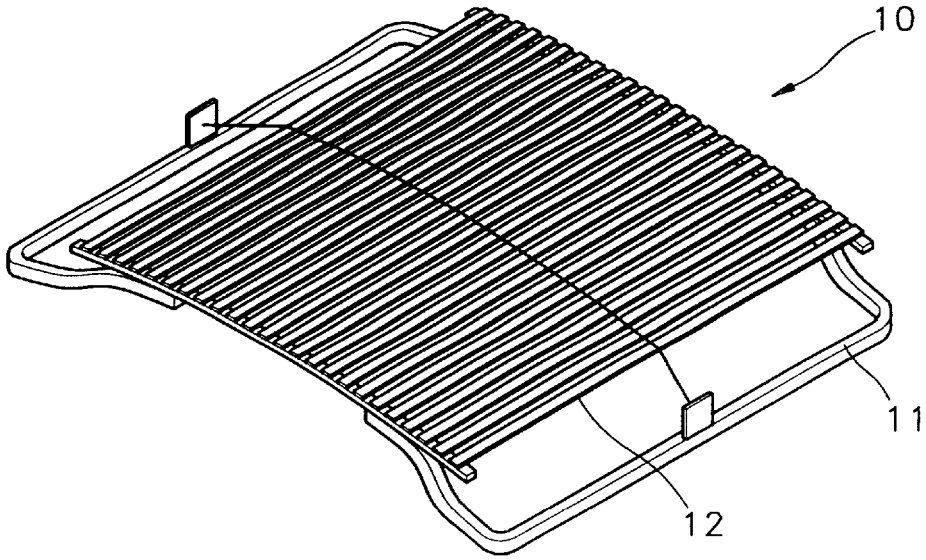
FIG. 1 (PRIOR ART)
FIG. 1 is a perspective view of a tension mask and frame assembly of a conventional color cathode ray tube (CRT)
Figure 2:
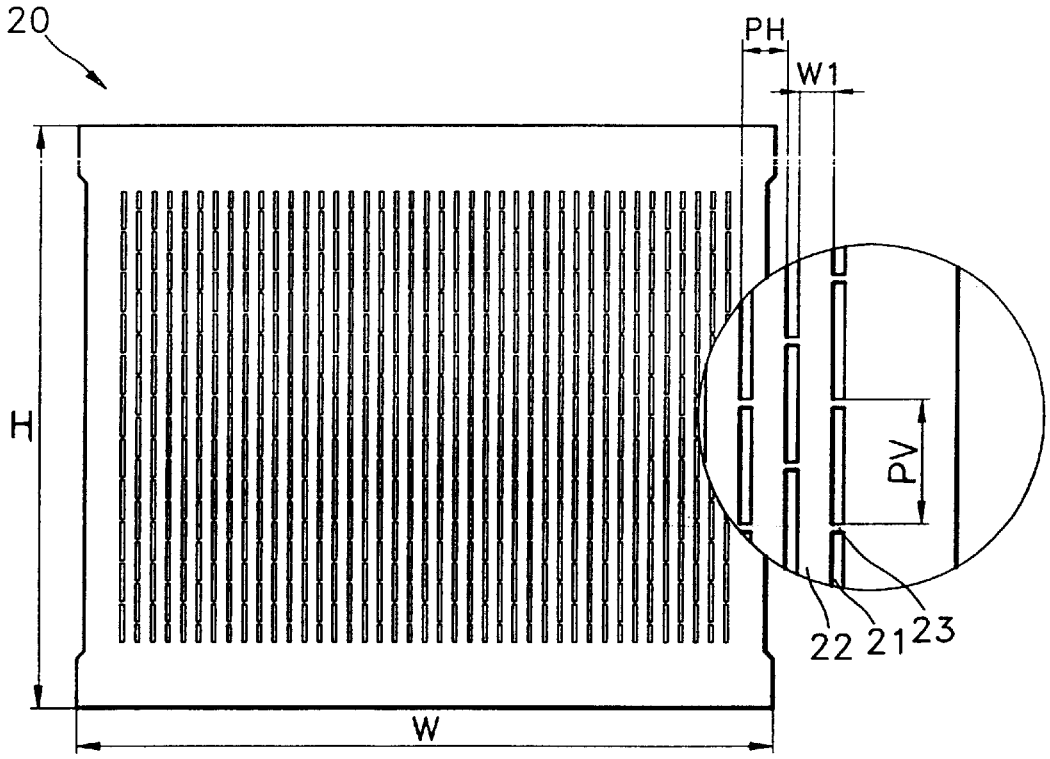
FIG. 2 (PRIOR ART)
FIG. 2 is a plan view of another conventional mask.
Figure 3:
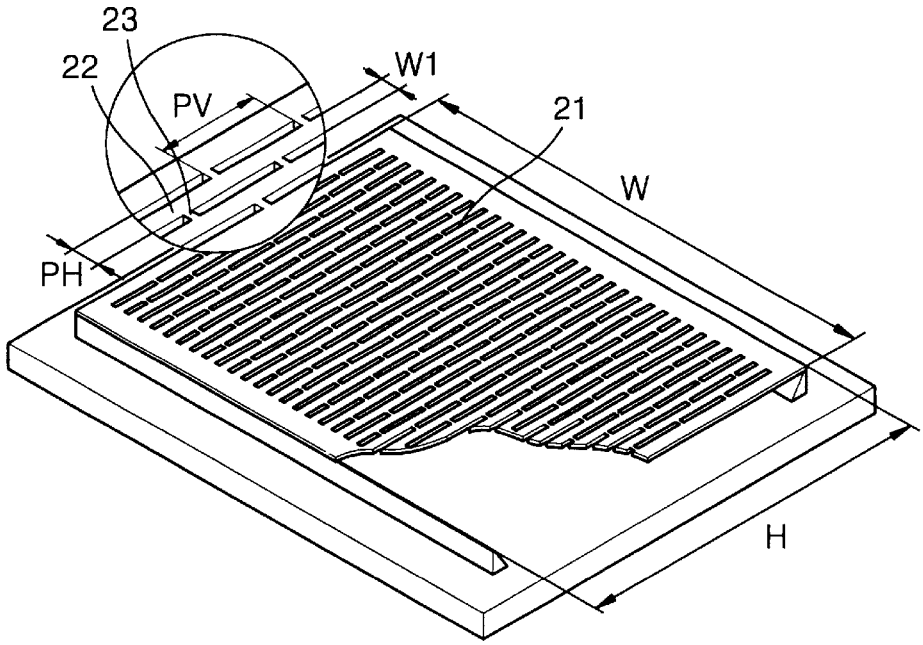
FIG. 3 (PRIOR ART)
FIG. 3 is a partially cut away perspective view of a mask and frame assembly of a conventional flat color CRT.
Figure 4:
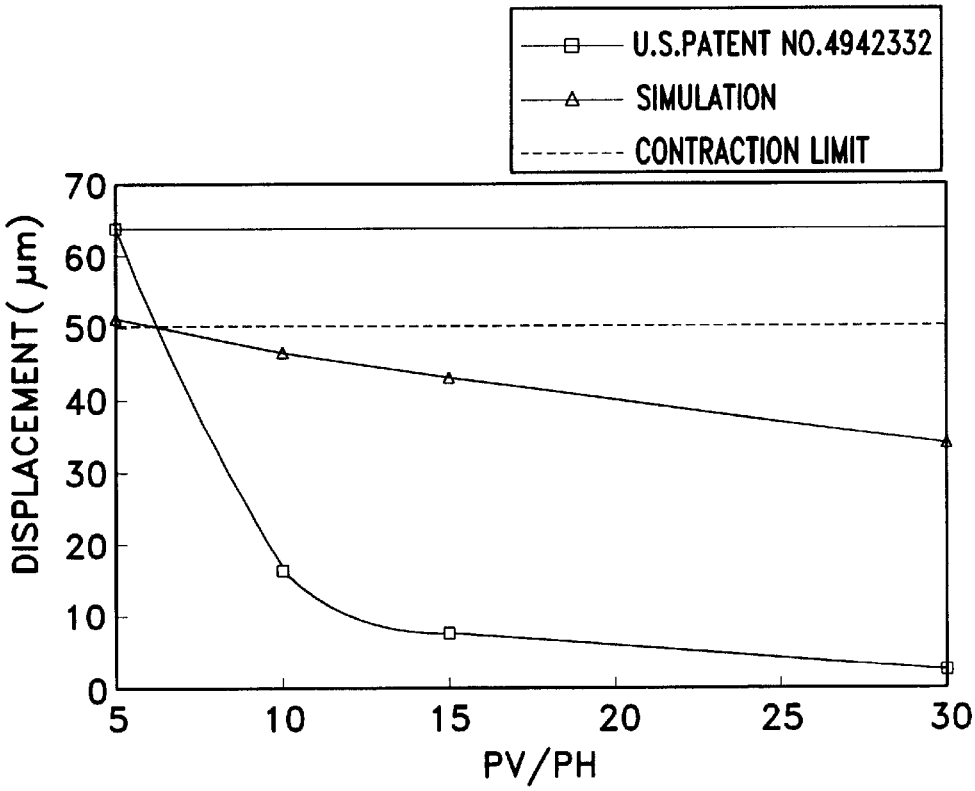
FIG. 4 (PRIOR ART)
FIG. 4 is a graph comparatively illustrating the displacement of the outermost slits of a mask with respect to a vertical-to-horizontal pitch ratio (PV/PH) of the slits according to a conventional technique and a numerical analysis.
Figure 5:
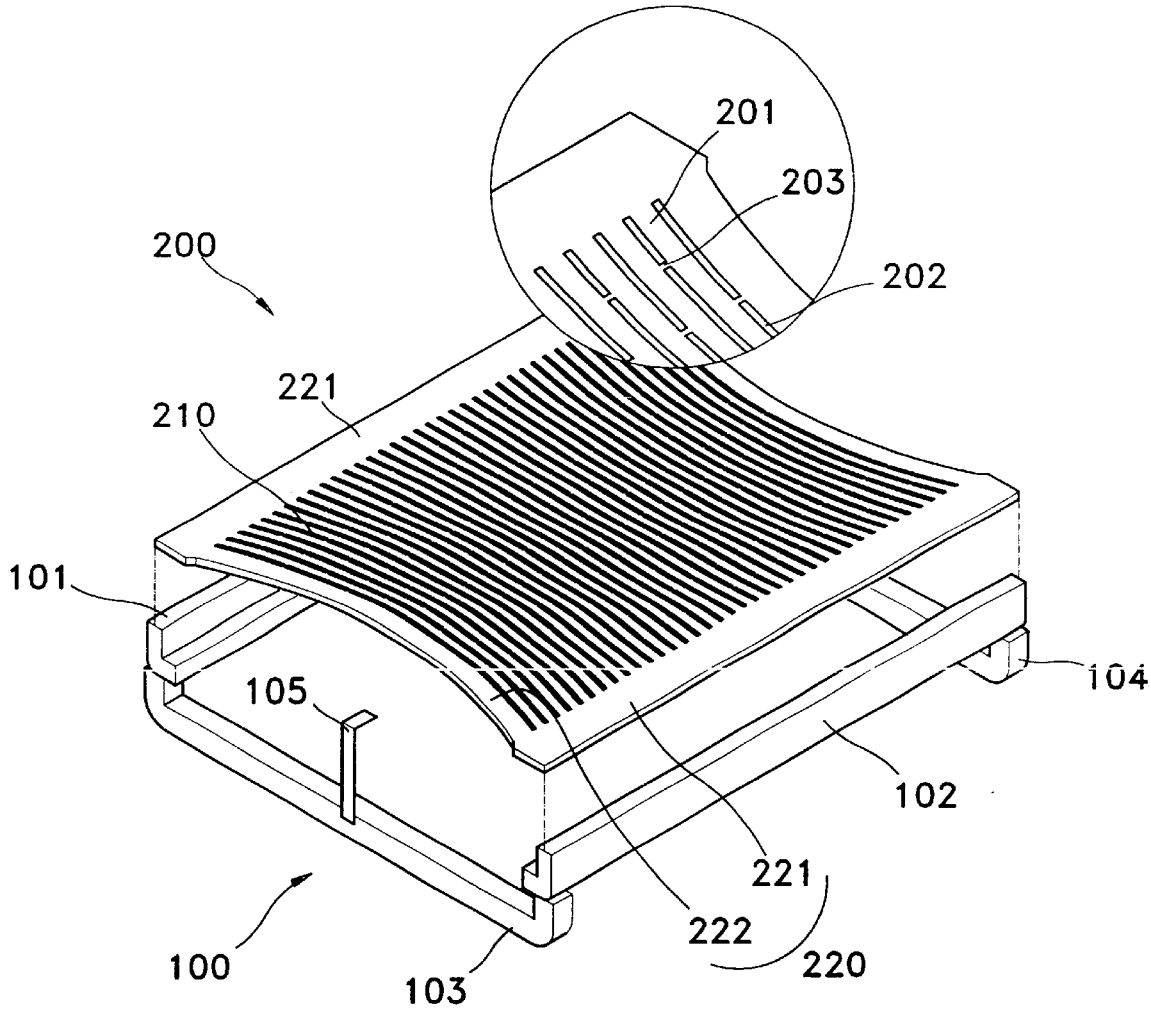
FIG. 5 is an exploded perspective view of a tension mask and frame assembly according to the present invention.

Referring to FIG. 5, which depicts a tension mask and frame assembly in which a tension mask is supported by a frame, according to the present invention, the tension mask frame assembly includes a frame 100 and a tension mask 200. The frame 100 has a pair of parallel support members 101 and 102 spaced apart from each other in predetermined intervals, and a pair of elastic members 103 and 104 fixed to the support members 101 and 102. Also, the tension mask 200 is supported by the frame 100 on upper and lower edges thereof.

The support members 101 and 102 of the frame 100 may be straight or may be bent to have a predetermined curvature on the basis of the curvature of the inner surface of the panel of a CRT. The elastic members 103 and 104 may have anti-vibration members 105 on the center thereof, to prevent the tension mask 200 from vibrating, in contact with the sides of the tension mask 200. The anti-vibration members 105 may be formed of a foil type metal tape or a heat-resistant synthetic resin or rubber. Any material capable of reducing the vibration of the tension mask 200 can be used as the anti-vibration member 105.

The tension mask 200, formed of a metal foil, includes an aperture portion 210, and a non-aperture portion 220 which surrounds the aperture portion 210. The aperture portion 210 has a series of strips 201 disposed at predetermined intervals to define slits 202, and a plurality of tie bars 203 interconnecting adjacent strips to divide the slits 202 at predetermined intervals. Also, the non-aperture portion 220 has top and bottom members 221 for supporting the strips 201, and side members 222 having a width equal to or wider than that of a single strip, which are disposed at the side of the aperture portion 210 while being spaced apart from each other.

Figure 6:
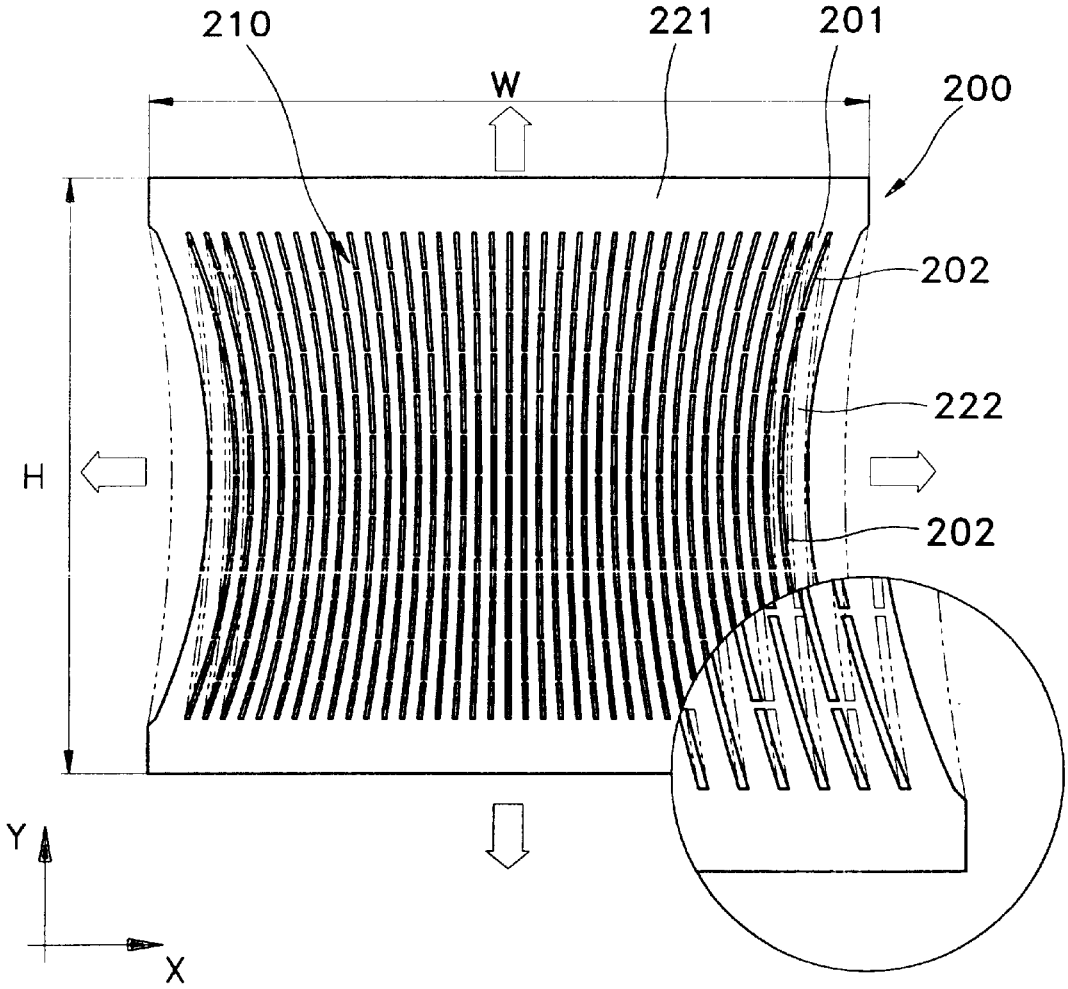
FIG. 6 is a plan view of the tension mask and frame assembly of FIG. 5.

As shown in FIG. 6, the tension mask 200 has a partial pin cushion shape. The side of the partial pin cushion shaped tension mask 200 allows tension in the tangential line direction (X-axis direction) of the strips 201 to the strips 201 and the side members 222 upon the tension mask 200 is secured to the support members 101 and 102. The partial pin cushion shape of the tension mask 200 results from the side members 222 and side strips 201 of the aperture portion 201 each of which have a predetermined curvature. Here, the curvature of the partial pin cushion shaped tension mask 200 sequentially decreases from the side members 222 toward the strips 201 of the aperture portion 201. Preferably, the side members 222 have a uniform width.

The degree of curvature of the aperture portion 210, and in particular, the side strips thereof, and of the side members 222 of the partial pin cushion shaped tension mask 200 can be controlled taking into account the width (W) and height (H) of the tension mask 200, the vertical pitch PV of the slit and the width W1 of a single strip, such that the tension applied to the tension mask 200 in the X-axis direction at the time of being assembled with the frame 100 can be varied. However, if the degree of curvature is too small, the displacement of the slits 202 at the side of the tension mask 200 cannot be effectively reduced. Thus, it is appreciated that the degree of curvature is in an appropriate range Preferably, a maximum curvature (δ) of the tension mask 200 is determined to be $0.00027W/2<\delta<0.01$ H. where W and H represent the width and height of the tension mask 200, respectively.

In particular, in a tension mask made of AK steel, the tensile strain of the tension mask in the Y-axis direction (parallel to the strips) is 0.1% or more of the height H of the tension mask. Assuming that a tension mask is formed of a metal foil without slits, the X-axial tensile strain of the tension mask is equal to the product of the Y-axial tensile strain (0.1%) and the Poisson's constant v (=0.27). That is, the X-axial tensile strain of the tension mask is 0.0027% or more. Thus, the degree of curvature of the tension mask should be high enough to cancel the X-axial tensile strain of the tension mask. Here, since the side members are symmetrical each other with respect to the center strip of the tension mask, the curvature (δ) of the tension mask is equal to 0.0027W/2 or more, where W represents the width of the tension mask.

Figure 7:
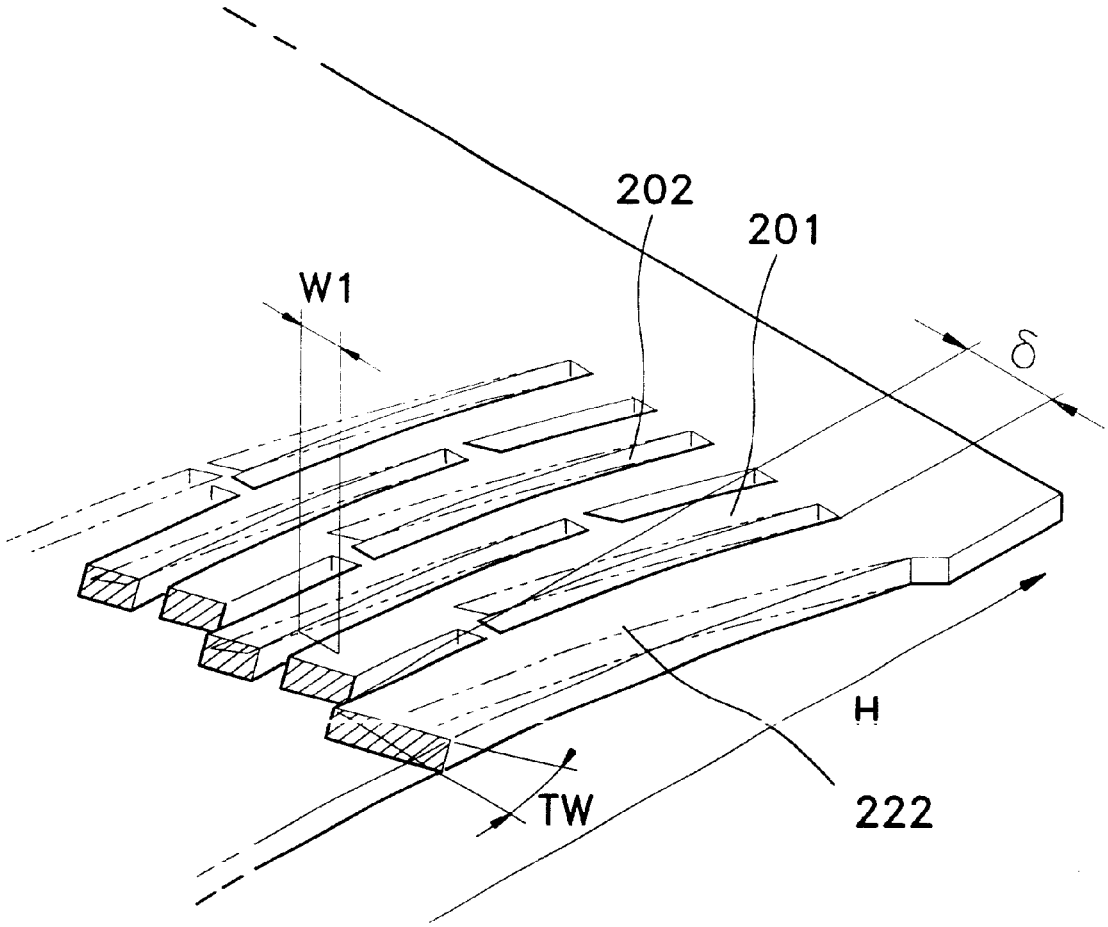
FIG. 7 is a partially cut away perspective view showing a condition of distortion of strips due to tension to the side strips and side members of the tension mask.

FIG. 7 shows a condition of distortion at the sides of the tension mask when a tension is applied to the side members and strips neighboring the side members.

If the degree of curvature of the tension mask is too large, the strips 201 and the side members 222 may be distorted. Assuming that the height of the tension mask is designated H and the width of a single strip is designated W1, the amount of the distortion is expressed by $W1\times(\delta/H)$. As a result of experimentation, which was conducted using a tension mask for a 21-inch CRT by the instant inventors, when $\delta/H=0.01$, the maximum distortion of the strip was 6 μm. However, there was no significant effects on electron beams passing through the slits 202 defined by the strips 201 to land on the phosphor screen. Thus, it should be noted that the degree of curvature (δ) of the tension mask is less than or equal to 0.01 H.

Figure 8:
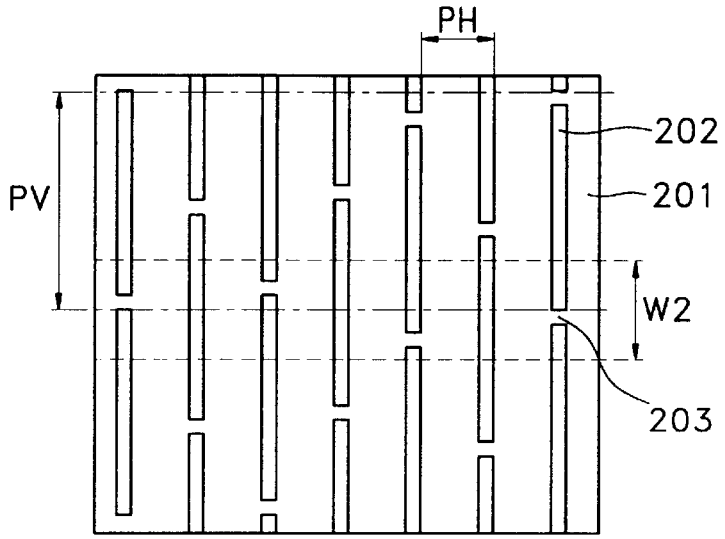
FIG. 8 is an enlarged plan view showing the relationship of the vertical pitch of slits and tie bar arrangement in the tension mask according to the present invention.

Also, a vertical-to-horizontal pitch ratio (PV/PH) of the slit should be considered to supply a tension in the vertical direction of the mask. Referring to FIG. 8, in a slit mask with the tie bars 203 interconnecting adjacent strips at predetermined intervals, the vertical pitch of the slit is designated PV and the horizontal pitch thereof is designated PH. If a tension is applied to the tension mask in the vertical direction at a PV/PH of 1 or less, stress is exerted upon the corners of the tension mask, which hinders tension from acting in the vertical direction of the tension mask. For sufficient vertical tension on the mask, it is preferable that the vertical-to-horizontal pitch ratio PV/PH is equal to or greater than 2.

Preferably, the tie bars 203 interconnecting adjacent strips are arranged so as not to form straight lines in the X-axis direction. This is for preventing the cumulative effect of the thermal expansion in the X-axis direction during operation of a CRT. More preferably, the tie bars 203 are randomly arranged in a staggered fashion in adjacent slits within an area of width W2 with a constant vertical pitch PV of the slit. The width W2 may be 10–40% of the vertical pitch PV of the slit.

Hereinafter, how a tension exerts on the partial pin cushion shaped tension mask according to the present invention, and the effects of the present invention during operation of a CRT will be described.

As the top and bottom members 221 of the partial pin cushion shaped tension mask are welded to the support members 101 and 102 of the frame 100, the X- and Y-axial tensions are applied to the tension mask 200. The Y-axial tension causes Poisson's contraction to the tension mask 200. Also, as the Y-axis tension is exerted on the tension mask 200, the side members 222 and the side strips 201 formed near the side of the aperture portion 210, which are formed with a predetermine curvature, become straight, exerting the X-axial tension on the tension mask 200. Here, since the side members 222 and the individual side strips 201 of the aperture portion 210 are interconnected by the tie bars 203, the X-axial tension acts on the entire area of the aperture portion 200. As mentioned above, because the tie bars 203 are randomly arranged in a range of 10–40% of the vertical pitch of the slits 202, a reflection image of the tie bars 203 does not appear on the screen of the CRT.

Due to the biaxial tension, which acts on the tension mask 200 as the tension mask 200 is secured to the support members 101 and 102 of the frame 100, the dislocation of the slits 202, in particular, of the slits near the side of the tension mask 200, which may occur during the mask-to-frame assembly or due to thermal expansion during operation of the CRT, can be avoided. That is, Poisson's contraction due to the Y-axis tension, and the X-axial tension which permits the side of the partial pin cushion shaped tension mask 200 to go straight, can be offset with each other, and the biaxial tension is strong enough to resist thermal expansion during operation of the CRT, so that the dislocation of the slits near the side of the aperture potion 210 can be suppressed.

The following experimental example is provided so that this disclosure will be thorough and complete.

Experimental Example

The dislocation of the slits near the side of the aperture portion with respect to the degree of the curvature of the tension mask, when a tension mask and frame assembly under Y-axis tension is heated by electronic energy, were observed. Here, the vertical-to-horizontal pitch ratio of the slits (PV/PH) for all the tension masks used were constant at PV/PH=15. The result is shown in FIG. 9.

Figure 9:
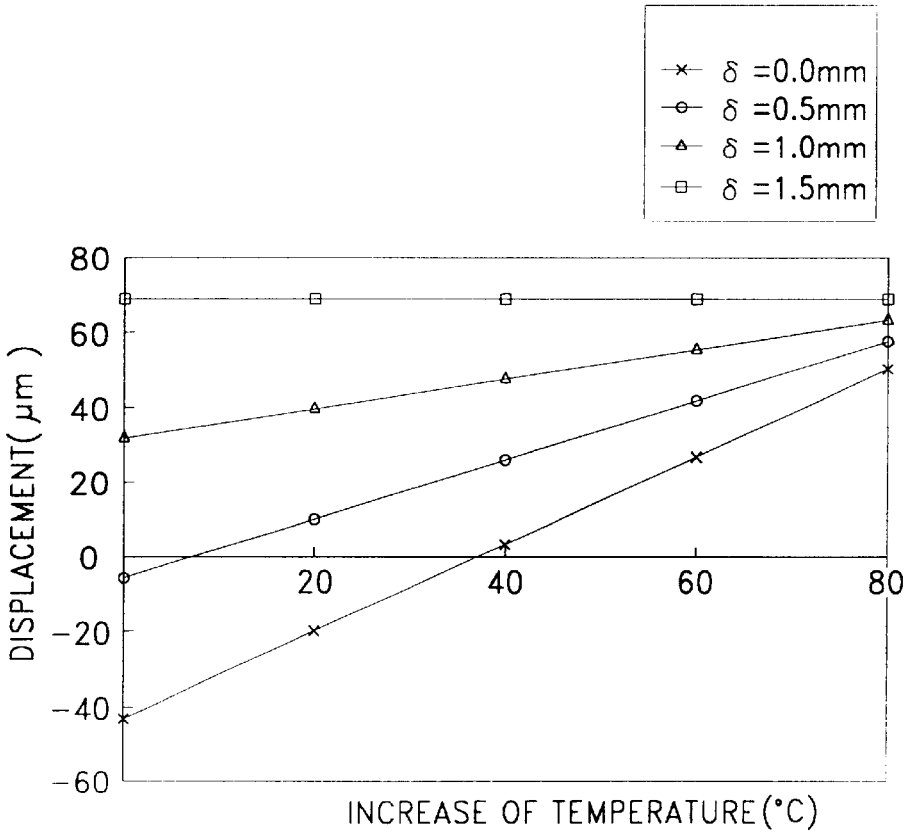
FIG. 9 is a graph illustrating the relationship of the maximum curvature of the tension mask and the slit displacement at the side of the tension mask.

As shown in FIG. 9, for the tension mask having no curvature ($\delta$=0), the position of the slits was shifted (−)43.1 $\mu$m inward at room temperature, relative to a reference position under zero tension, exclusively due to the Y-axis tension applied during the mask-to-frame assembly. When the temperature was raised to 40° C., the position of the slits was shifted slightly outward 3.6 $\mu$m relative to the reference position. Also. the position of the slits was shifted 50.4 $\mu$m outward at 80° C. due to thermal expansion of the tension mask. Accordingly, the total dislocation of the slits, from contraction by the Y-axis tension to the expansion by the heating to 80° C., amounts to 94 $\mu$m. Such dislocation of the slits causes drifting of electron beams when a CRT starts to operate, thereby deteriorating the color purity of a display image For the tension mask having a curvature of 1.5 mm, the position of the slits was shifted 68 $\mu$m outward, relative to the reference position, under the Y-axis tension even at room temperature. Also, when the temperature was raised to 80° C., the position of the slit barely shifted with a difference of 0.9 $\mu$m from the slit position at room temperature. In this case, the dislocation of the slits due to the thermal expansion during the operation of a CRT is minimized, so that the drifting of the electron beams can be also minimized, permitting the CRT to display a stable image within a short period of time.

Also, in the tension mask and frame assembly according to the present invention, due to the anti-vibration member fixed at the center of the elastic members of the frame to hold the side of the tension mask, the vibration of the individual strips of the tension mask, which may be caused by external impact, can also be suppressed.

As described above, the tension mask, and the tension mask and frame assembly for a CRT according to the present invention are manufactured to have a partial pin cushion shape by providing a predetermined curvature to the side of the tension mask and the side strips of the aperture portion. Accordingly, when the Y-axial tension is applied during the mask-to-frame assembly, the curved sides of the tension mask become straight, exerting the X-axial tension on the entire area of the tension mask through the tie bars randomly interconnecting adjacent strips. As a result, Poisson's contraction due to the Y-axis tension can be nearly completely offset, and the dislocation of the slits resulting from Poisson's contraction, and the thermal expansion during operation of a CRT, can be suppressed.

Also, the tension mask according to the present invention is designed to have a partial pin cushion shape, so that the inner surface of the faceplate can have a predetermined curvature in the vertical direction. Thus, the thickness of the panel near the loner sides thereof can be larger than that at the center thereof, which allows the panel to be resilient against explosion, and the center of a CRT no longer appears to be depressed.

While the present invention has been illustrated and described with reference to specific embodiments, further modifications and alterations within the spirit and scope of this invention as defined by the appended claims will become evident to those skilled in the art.

What is claimed is:

1. A tension mask for a cathode ray tube (CRT), comprising:

upper and lower bar members;

a series of spaced strips extending between and connecting said bar members; and a plurality of tie bars interconnecting adjacent said strips whereby adjacent said strips are separated by a plurality of slits except for said tie bars;

wherein the strips in opposite side regions of said tension mask, including outermost ones of said strips, are curved convexly inwardly so that when a first tension is applied to stretch said strips in a longitudinal direction thereof and simultaneously causing Poisson contraction of said strips in a direction transverse to the longitudinal direction, a second tension occurs, due to the inwardly convex curvature of said strips, to compensate for the Poisson contraction of said strips .

2. The tension mask of claim 1, wherein assuming that a maximum curvature of the strips is $\delta$, and a height of the tension mask is H and a width of the tension mask is W, a relationship of $0.00027W/2<\delta<0.01H$ is satisfied.

3. The tension mask of claim 1, wherein each of the outermost strips has a substantially uniform width.

4. The tension mask of claim 3, wherein each of the strips has a substantially uniform width and the width of the outermost strips is wider than the width of the remaining strips.

5. The tension mask of claim 1, wherein the strips are arranged with a vertical pitch of PV, as measured in the longitudinal direction, and a horizontal pitch of PH, as measured in the transverse direction, and a vertical-to-horizontal pitch ratio PV/PH is greater than or equal to 2.

6. The tension mask of claim 1, wherein curvatures of the strips decrease with increasing distance from the associated outermost strip.

7. The tension mask of claim 6, wherein the strips in a central region between the opposite side regions of the tension mask are substantially straight.

8. The tension mask of claim 1, wherein the strips are arranged with a substantially constant vertical pitch , as measured in the longitudinal direction;

the tie bars are arranged in a staggered fashion to form. together with the strips, a brick-wall arrangement; and the slits and tie bars located between each pair of adjacent said strips are considered to be arranged in a column, and the tie bars in every second said column are distributed in a number of stripes extending in the transverse direction, each of said stripes having a height measured in the longitudinal erection within a range of from about 10 to about 40% of the constant vertical pitch.

9. A tension mask and frame assembly for a cathode ray tube (CRT), comprising:

a tension mask including upper and lower bar members, a series of spaced strips extending between and connecting said bar members , and a plurality of tie bars interconnecting adjacent said strips whereby adjacent said strips are separated by a plurality of slits except for said tie bars, the strips in opposite side regions of said tension mask, including outermost ones of said strips, being curved convexly inwardly; and a frame including a pair of support members disposed parallel to each other and a pair of elastic members connecting respective ends of the support members to each other for supporting the support members;

wherein the bar members of the tension mask are respectively bonded to the support members of the frame while a first tension is being applied to stretch the strips in a first direction, thereby causing a second tension to occur, due to the inwardly convex curvature of the strips, in a second direction transverse to the first direction, said second tension spreads throughout the tension mask via the tie bars and moves the curved strips outwardly.

10. The tension mask and frame assembly of claim 9, further comprising anti-vibration members disposed in contact with the outermost strips of the tension mask, said anti-vibration members being supported by the elastic members.

11. The tension mask and frame assembly of claim 9, wherein assuming that a maximum curvature of the strips is $\delta$, and a height of the tension mask is H and a width of the tension mask is W, a relationship of $0.00027W/2<\delta<0.01H$ is satisfied.

12. The tension mask and frame assembly of claim 9, wherein the strips are arranged with a vertical pitch of PV, as measured in the first direction, and a horizontal pitch of PH, as measured in the second direction, and a vertical-to-horizontal pitch ratio PV/PH is greater than or equal to 2.

13. The tension mask and frame assembly of claim 9, wherein curvatures of the strips decrease with increasing distance from the associated outermost strip.

14. The assembly of claim 9, wherein after the mask has been bonded to the frame under tension, the slits immediately adjacent to the outermost strips are oriented substantially in the first direction.

15. The assembly of claim 14, wherein after the mask has been bonded to the frame under tension, all said slits are oriented substantially in the first direction.

16. The assembly of claim 15, wherein said slits remain substantially oriented in the first direction at any temperature of the tension mask in a range between the room temperature and a normal operational temperature of the CRT.

17. The assembly of claim 9, wherein each of the strips has a substantially uniform width.

18. The assembly of claim 17, wherein after the mask has been bonded to the frame under tension, the outermost strips become substantially straight.

19. The assembly of claim 18, wherein the outermost strips remain substantially straight at any temperature of the tension mask in a range between the room temperature and a normal operational temperature of the CRT.

20. The assembly of claim 9, wherein after the mask has been bonded to the frame under tension, the tie bars are arranged in a staggered fashion so as not to form straight lines in the second direction, thereby avoiding an cumulative effect of thermal expansion in the second direction during operation of the CRT.

21. The assembly of claim 9, herein the first and second direction are respectively the vertical and horizontal directions of the CRT during operation.

* * * * *